US006343463B1

(12) United States Patent
Mei

(10) Patent No.: US 6,343,463 B1
(45) Date of Patent: Feb. 5, 2002

(54) SUPPORT AND LOCKING DEVICE FOR NOZZLES OF A HIGH PRESSURE STAGE OF A GAS TURBINES

(75) Inventor: Luciano Mei, Florence (IT)

(73) Assignee: Nuovo Pignone S.p.A., Florence (IT)

( * ) Notice: Subject to any disclaimer, the term of this patent is extended or adjusted under 35 U.S.C. 154(b) by 0 days.

(21) Appl. No.: 09/579,521

(22) Filed: May 26, 2000

(30) Foreign Application Priority Data

May 31, 1999 (IT) ..... MI99A1206

(51) Int. Cl.[7] ..... F01D 9/04

(52) U.S. Cl. ..... 60/39.31; 60/39.32; 415/115; 415/135; 415/189; 415/209.2; 415/209.3; 415/209.4

(58) Field of Search ..... 415/189, 190, 415/209.2, 209.3, 209.4, 210.1, 115, 116, 135; 60/39.31, 39.32

(56) References Cited

U.S. PATENT DOCUMENTS 3,262,677 A * 7/1966 Bobo et al. ..... 415/209.4
4,126,405 A * 11/1978 Bobo et al. ..... 415/115
4,153,386 A * 5/1979 Leogrande et al. ..... 415/115
4,616,976 A * 10/1986 Lings et al. ..... 415/115
5,118,120 A * 6/1992 Drerup et al. ..... 415/135
5,211,536 A * 5/1993 Ackerman et al. ..... 415/209.3
5,224,822 A * 7/1993 Lenahan et al. ..... 415/189
5,271,714 A * 12/1993 Shepherd et al. ..... 415/209.2
5,372,476 A * 12/1994 Hemmelgarn et al. ..... 415/135
6,095,750 A * 8/2000 Ross et al. ..... 415/189

FOREIGN PATENT DOCUMENTS

GB 1385666 A * 2/1975 ..... 415/190

* cited by examiner

*Primary Examiner*—Christopher Verdier
(74) *Attorney, Agent, or Firm*—Nixon & Vanderhye

(57) ABSTRACT

A support and locking device for nozzles of a high-pressure stage in gas turbines comprises a plurality of groups of stator vanes, which are associated with a plurality of outer sealing plates, for connection of the groups to the outer liner of the combustion chamber, and are associated with a plurality of inner sealing plates, for connection of the groups to the inner liner of the combustion chamber. Each of the groups of stator vanes is locked by an inner ring, and the ring has a first series of outer holes to reinforce this locking, and a second series, of inner, through holes, which are provided in an inner extension of the ring and are used to secure the ring itself to the structure of the gas turbine.

11 Claims, 8 Drawing Sheets

SUPPORT AND LOCKING DEVICE FOR NOZZLES OF A HIGH PRESSURE STAGE OF A GAS TURBINES

The present invention relates to a support and locking device for nozzles of a high-pressure stage in gas turbines.

As is known, gas turbines are machines which consist of a compressor and of a turbine with one or more stages, wherein these components are connected to one another by a rotary shaft, and wherein a combustion chamber is provided between the compressor and the turbine.

In order to pressurise the compressor, it is supplied with air obtained from the outer environment.

The compressed air passes through a series of pre-mixing chambers, which end in a converging portion, otherwise known as the shroud, into each of which an injector supplies fuel which is mixed with the air, in order to form an air-fuel mixture to be burnt.

In order to improve the combustion characteristics, there is generally provided an element which intercepts the flow of air obtained from the compressor, and has a complex shape, consisting of two series of blades, oriented in opposite directions, all of which is designed to produce turbulence in the air-fuel mixture.

There is admitted into the combustion chamber the fuel, which is ignited by means of corresponding spark plugs, in order to produce the combustion, which is designed to give rise to an increase in the temperature and pressure, and thus to enthalpy of the gas.

Simultaneously, the compressor supplies compressed air, which is passed both through the burners, and through the liners of the combustion chamber, such that the said compressed air is available to assist the combustion.

Subsequently, via corresponding ducts, the high-temperature, high-pressure gas reaches the various stages of the turbine, which transforms the enthalpy of the gas into mechanical energy which is available to a user.

In two-stage turbines, the gas is processed in the first stage of the turbine, in temperature and pressure conditions which are quite high, and undergoes initial expansion there; whereas in the second stage of the turbine, the gas undergoes second expansion, in temperature and pressure conditions which are lower than in the previous cases.

It is also known that in order to obtain the best performance from a specific gas turbine, the temperature of the gas needs to be as high as possible; however, the maximum temperature values which can be obtained when using the turbine are limited by the resistance of the materials used.

In order to make apparent the technical problems which are solved by the present invention, a brief description is provided hereinafter of a stator of a high-pressure stage of a gas turbine according to the known art.

Downstream from the combustion chamber, the turbine has a high-pressure stator and rotor, wherein the stator is used to supply the flow of burnt gases in suitable conditions to the intake of the rotor, and, in particular, to direct it in an appropriate manner into the apertures of the rotor blades, and prevent the flow from meeting directly the dorsal or convex surface and the ventral or concave surface of the blades.

The stator consists of a series of stator vanes, between each pair of which a corresponding nozzle is provided.

The group of stator vanes is in the shape of a ring, and is connected externally to the turbine housing, and internally to a corresponding support.

In this respect, it should be noted that a first technical problem of the stators, in particular in the case of high-pressure stages, is caused by the fact that the stator is subjected to high pressure loads, owing to the reduction of pressure of the fluid, which expands in the stator apertures.

In addition, the stator is subjected to high temperature levels, owing to the flow of hot gases obtained from the combustion chamber and, to the flows of cold air which are introduced into the turbine, in order to cool the parts which are subjected to the greatest stress from a thermal point of view.

Specifically because of these high temperatures, the stator vanes which are used in the high-pressure stage of turbines must be cooled, and, for this purpose, they have a surface which is suitably provided with holes for ducts, which permit circulation of air inside the stator vane itself.

Another problem which is particularly well known in the art is that of guaranteeing optimum support and locking of the stator vanes, in particular in the high-pressure stage.

In addition, conventional stators have support and locking systems which do not permit easy dismantling, when this is necessary in order to carry out operations of maintenance or replacement of one or more stator vanes which are worn or damaged.

Another problem consists in the fact that the stators are subject to the vibrations transmitted by the stator vanes during functioning of the machine.

However, the stator vanes must have small dimensions, because the high-pressure gases have a very high density; this means that the cross-sections of passage of the first stages must be considerably smaller than the cross-sections of passage of the subsequent stages, when the gas has undergone initial expansion.

The object of the present invention is thus to provide a support and locking device for nozzles of a high-pressure stage in gas turbines, which is particularly reliable.

A further object of the invention is to provide a device which has a simple and compact structure.

A further object of the invention is to provide a device which has a low cost, and consists of a reduced number of component parts.

Yet another object of the invention is to provide a support and locking device for nozzles of a high-pressure stage in gas turbines, which permits easy fitting and dismantling of the stator vanes as required, in order to carry out maintenance and optionally replacement of the latter.

A further object of the invention is to provide a device which permits optimum distance to the vibrations which affect the stator vanes, and to prevent these vibrations from being transferred to the other elements of the motor.

A further object of the invention is to provide a device which is safe, simple and economical.

These objects and others are achieved by a support and locking device for nozzles of a high-pressure stage in gas turbines, comprising a plurality of groups of stator vanes, which are associated with a plurality of outer sealing plates for connection of these groups to the outer liner of the combustion chamber, and are associated with a plurality of inner sealing plates, for connection to the inner liner of the combustion chamber, characterised in that each of the said groups of stator vanes is locked at an inner ring, wherein the said ring has a first series of outer holes to reinforce this locking, and a second series, of inner, through holes, which are provided in an inner extension of the said ring, and are used to secure the ring itself to the structure of the gas turbine.

According to a preferred embodiment of the present invention, each of the groups of stator vanes has outer slots for engagement with the outer sealing plates, and inner slots for engagement with the inner sealing plates.

In addition, each of the groups of stator vanes is connected via the outer slots to the outer sealing plates, by means of a first group of pins, and via the inner slots to the inner sealing plates, by means of a second group of pins.

According to another preferred embodiment of the present invention, a peripheral portion of the ring has a circumferential groove, which communicates with the through holes, which in turn are aligned with corresponding blind holes.

According to a further preferred embodiment of the present invention, the groups of stator vanes have on their interior plates which are provided with holes, wherein these plates are inserted inside the circumferential groove, such that the holes communicate with through holes in order to reinforce the locking of the groups of stator vanes onto the ring, by means of pins.

According to a another preferred embodiment of the present invention, each of the groups of stator vanes has projections which abut the body of the gas turbine.

According to another preferred embodiment of the present invention, the ring has a duct which communicates between the exterior of the combustion chamber, and the downstream portion of the groups of stator vanes, which opens onto a front portion of the ring, and has a first portion, and a second portion, which has a diameter smaller than the first portion, and wherein the first and second portions are connected to one another by a further, frusto-conical portion.

In addition, the duct opens in the rear portion of the ring, facing the said plate-type element, into a final, frusto-conical portion.

Further characteristics of the invention are defined in the claims which are attached to the present patent application.

Further objects and advantages of the present invention will become apparent from examination of the following description and the attached drawings, which are provided purely by way of non-limiting, explanatory example, and in which.

Figure 1:
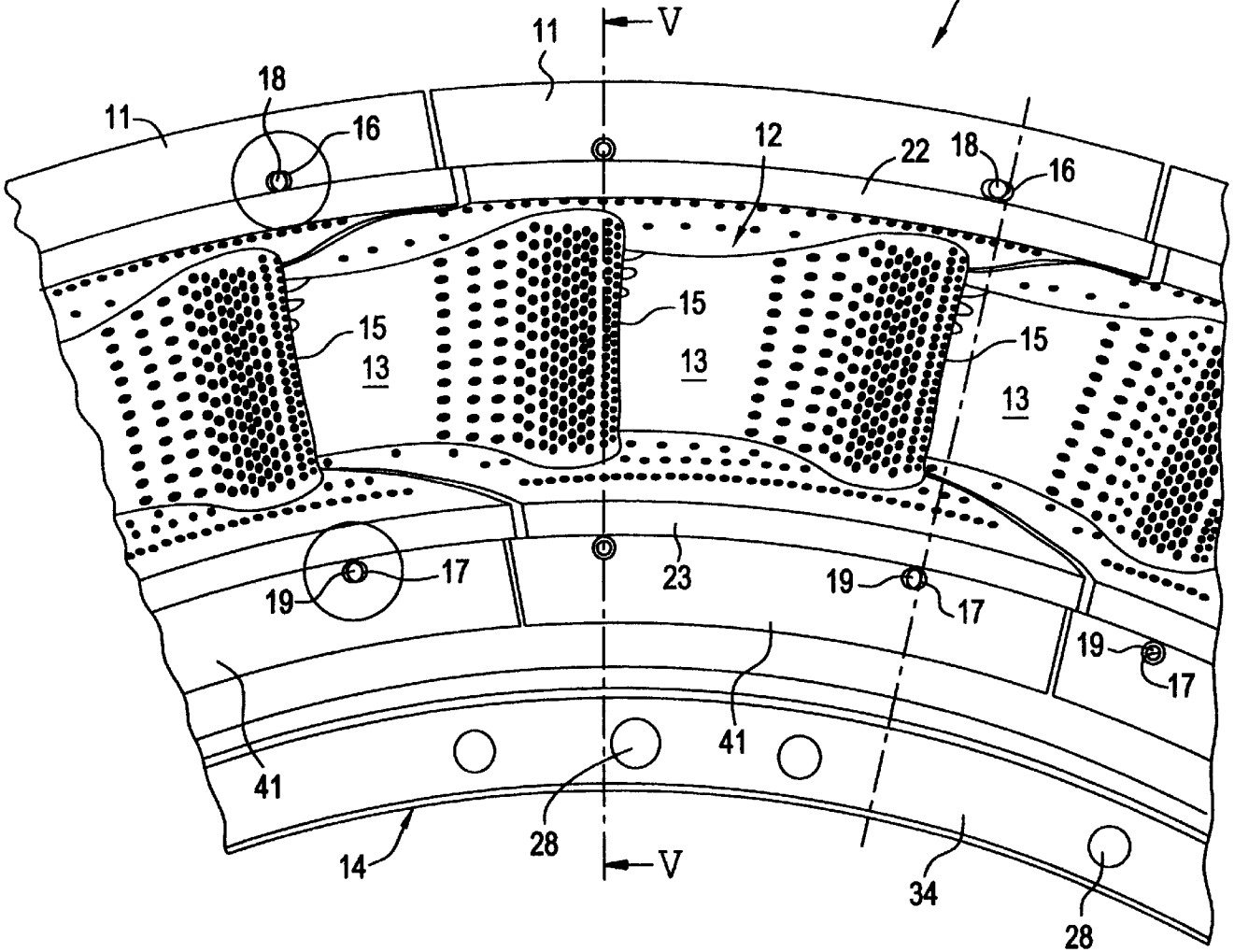
FIG. 1 shows a front view of a portion of a group of stator vanes, locked by means of a device according to the present invention.
Figure 2:
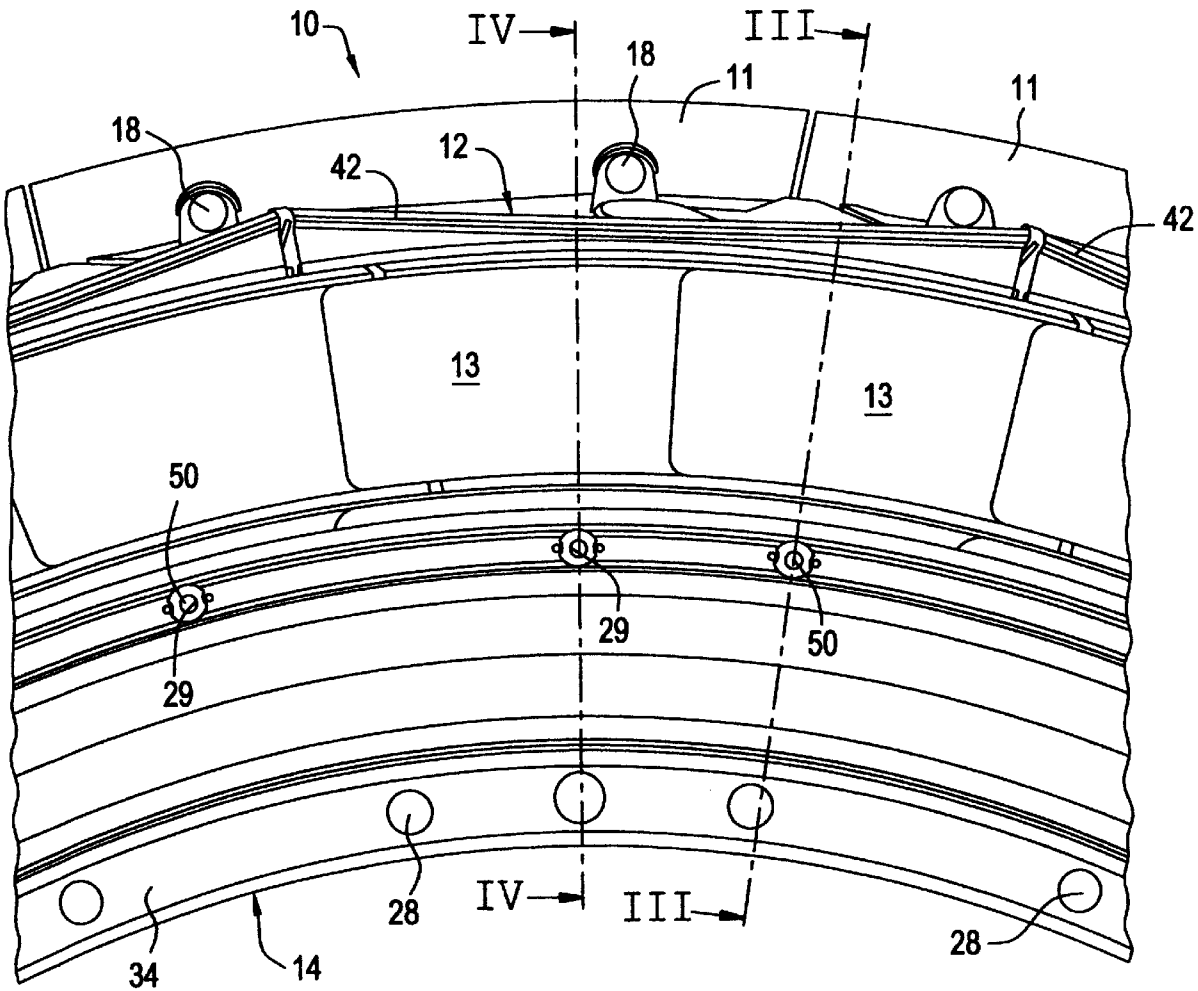
FIG. 2 shows a rear view of a portion of the group of stator vanes shown in FIG. 1.
Figure 3:
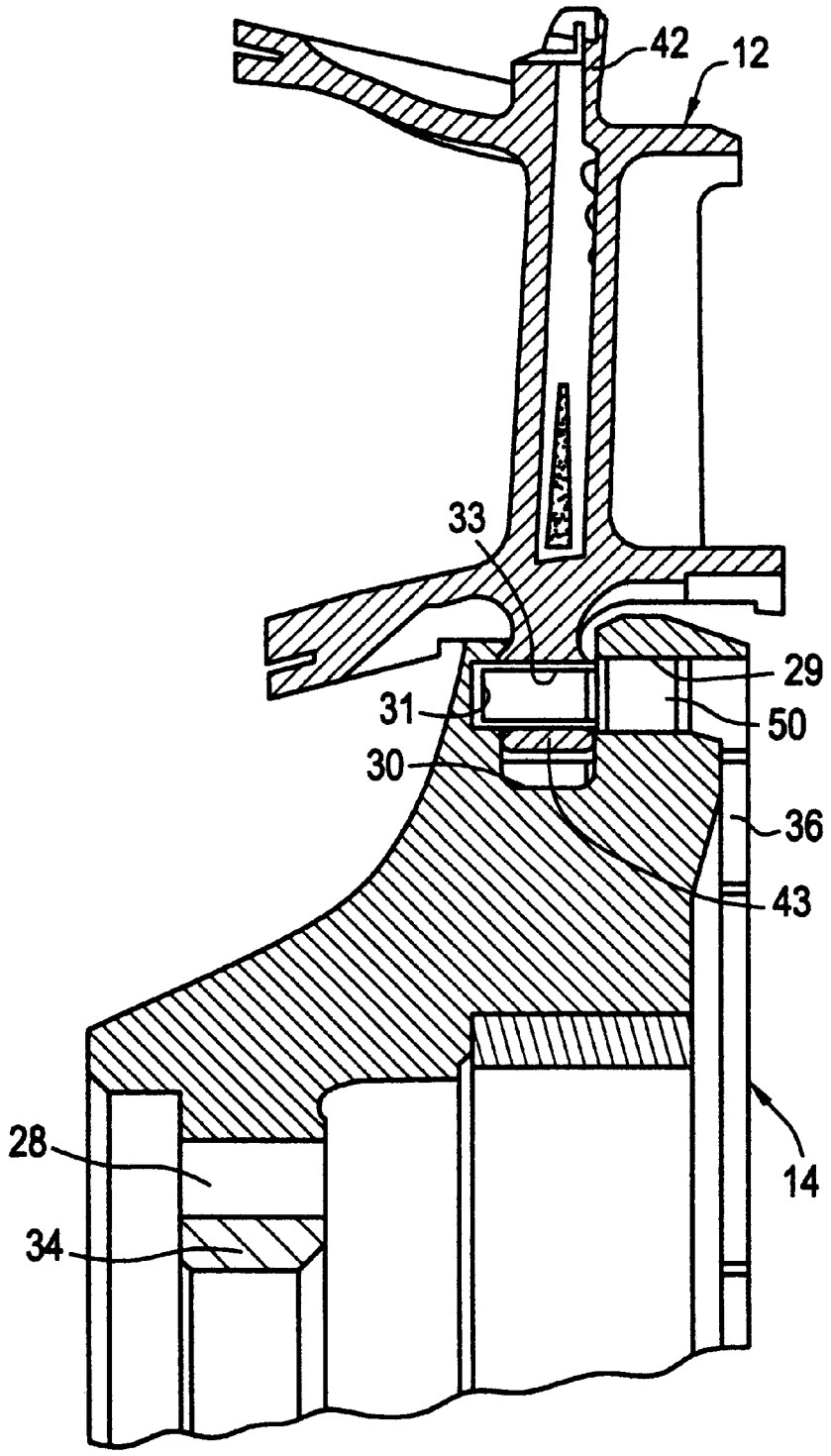
FIG. 3 shows a view according to the cross-section along the line III—III in FIG. 2.

With particular reference to the Figures in question, the support and locking device for nozzles of a high-pressure stage in gas turbines, according to the present invention, is indicated as a whole by the reference number 10.

The device 10 comprises a plurality of groups 12 of stator vanes 13, each of which is connected via an outer sealing plate 11 to the outer liner of the combustion chamber of the gas turbine (not shown for the sake of simplicity), all of which is designed to ensure, by means of their contact, that the hot gases produced in the combustion chamber flow in their entirety through the stator vanes.

Each group 12 of stator vanes 13 is also associated with an inner sealing plate 41, for connection to the inner liner of the gas combustion chamber (not shown for the sake of simplicity).

The inner sealing plate 41 functions in a manner similar to the outer sealing plate 11.

Thus, the groups 12 of stator vanes 13 are supported along an annular profile which determines the cross-section of passage of the gases, and are contained between the outer sealing plates 11 and the inner sealing plates 41.

In greater detail, each group 12 consists of a pair of stator vanes 13, which, by means of their reciprocal positions, form the nozzles 15 for the passage of gas; in addition, the stator vanes 13 have on their outer surface a plurality of cooling holes, which communicate with inner cooling ducts.

The group 12 of stator vanes 13 is contained between an outer arched profile 22 and an inner arched profile 23, and each of the vanes 13 has a corresponding winged-shaped profile.

Each group 12 of stator vanes 13 has outer slots 16 for engagement with the sealing plates 11, and inner slots 17 for engagement with the inner sealing plates 41.

Figure 4:
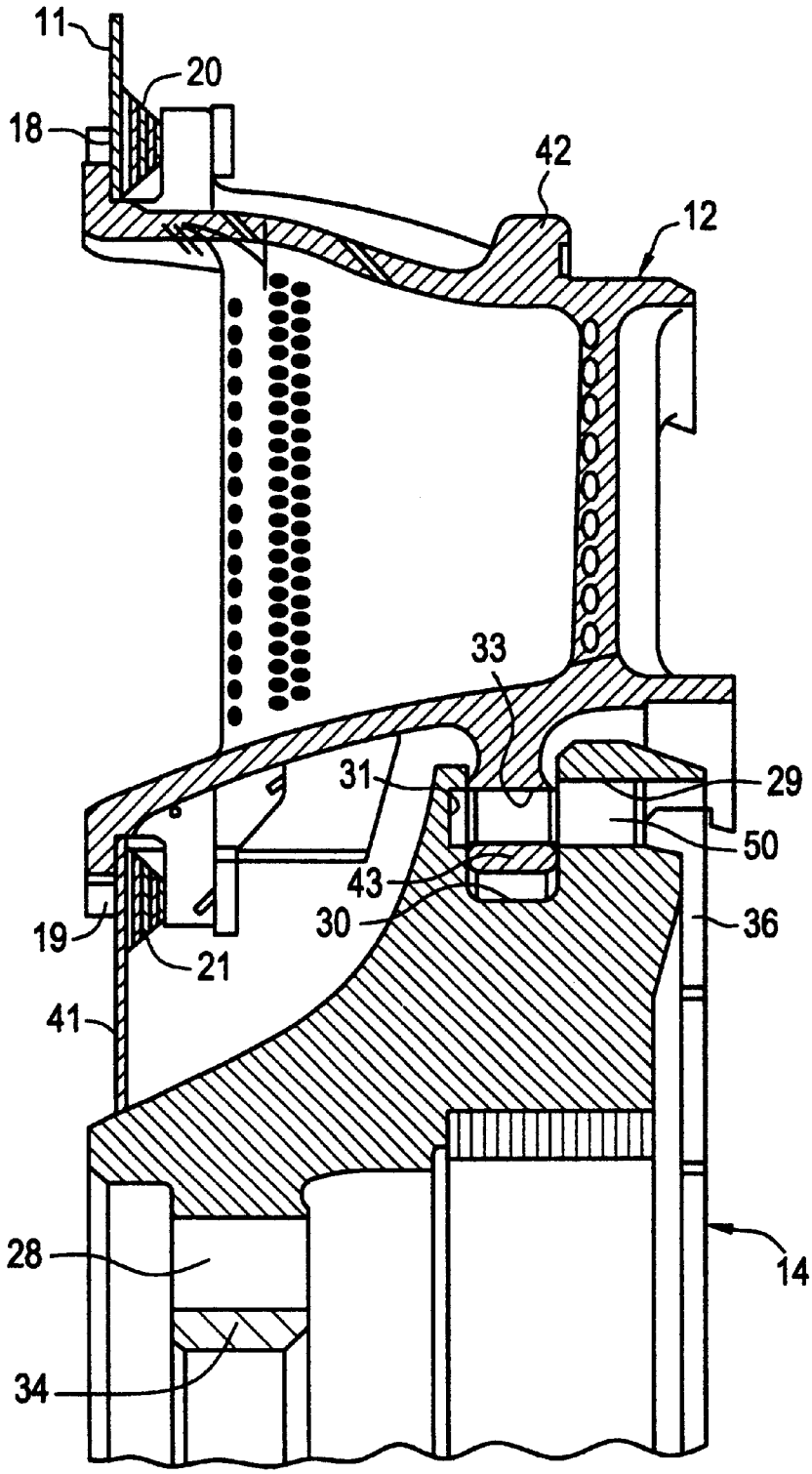
FIG. 4 shows a view according to the cross-section along the line IV—IV in FIG. 2.
Figure 5:
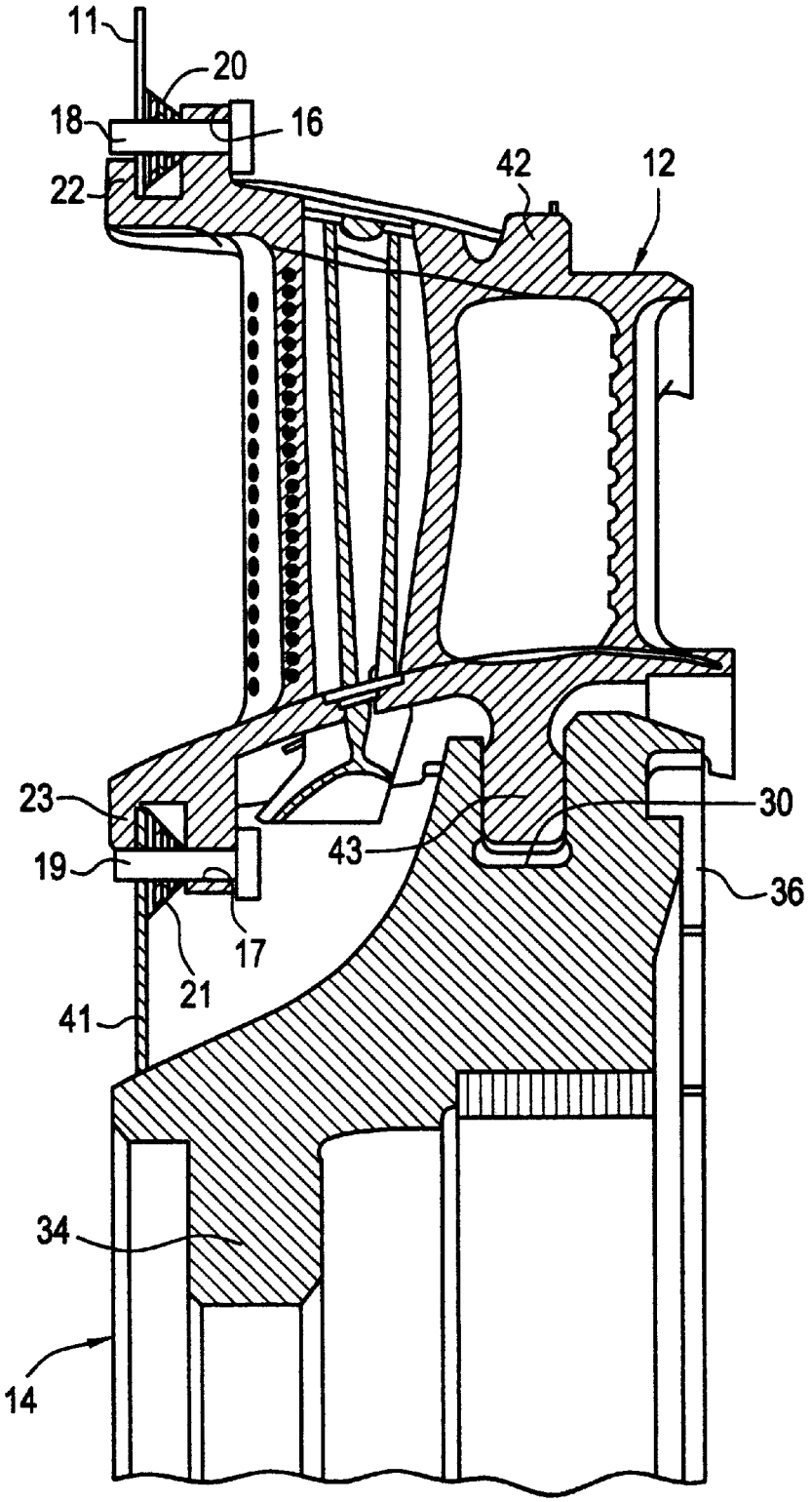
FIG. 5 shows a view in cross-section according to the line V—V in FIG. 1.
Figure 6:
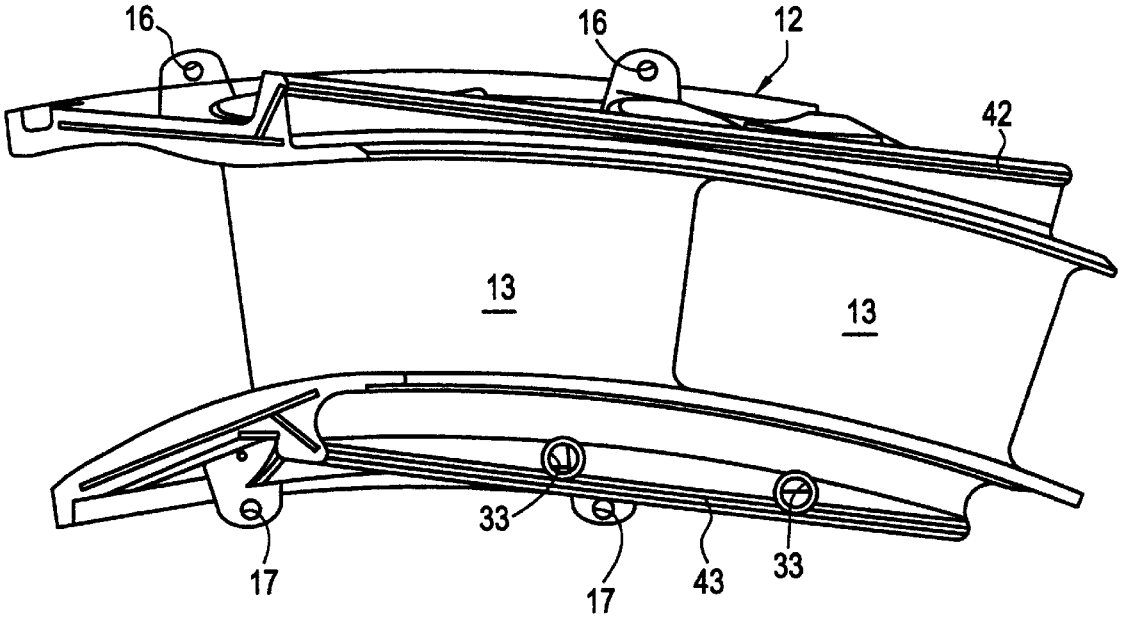
FIG. 6 shows a rear view of a group of stator vanes.

In order to reinforce the connection of the groups 12, pins 18 are used for the outer slots 16, and pins 19 are used for the inner slots 17, as can be seen for example in FIGS. 4–5.

This connection is also improved by means of use of springs 20 for the pins 18, and springs 21 for the pins 19.

Figure 7:
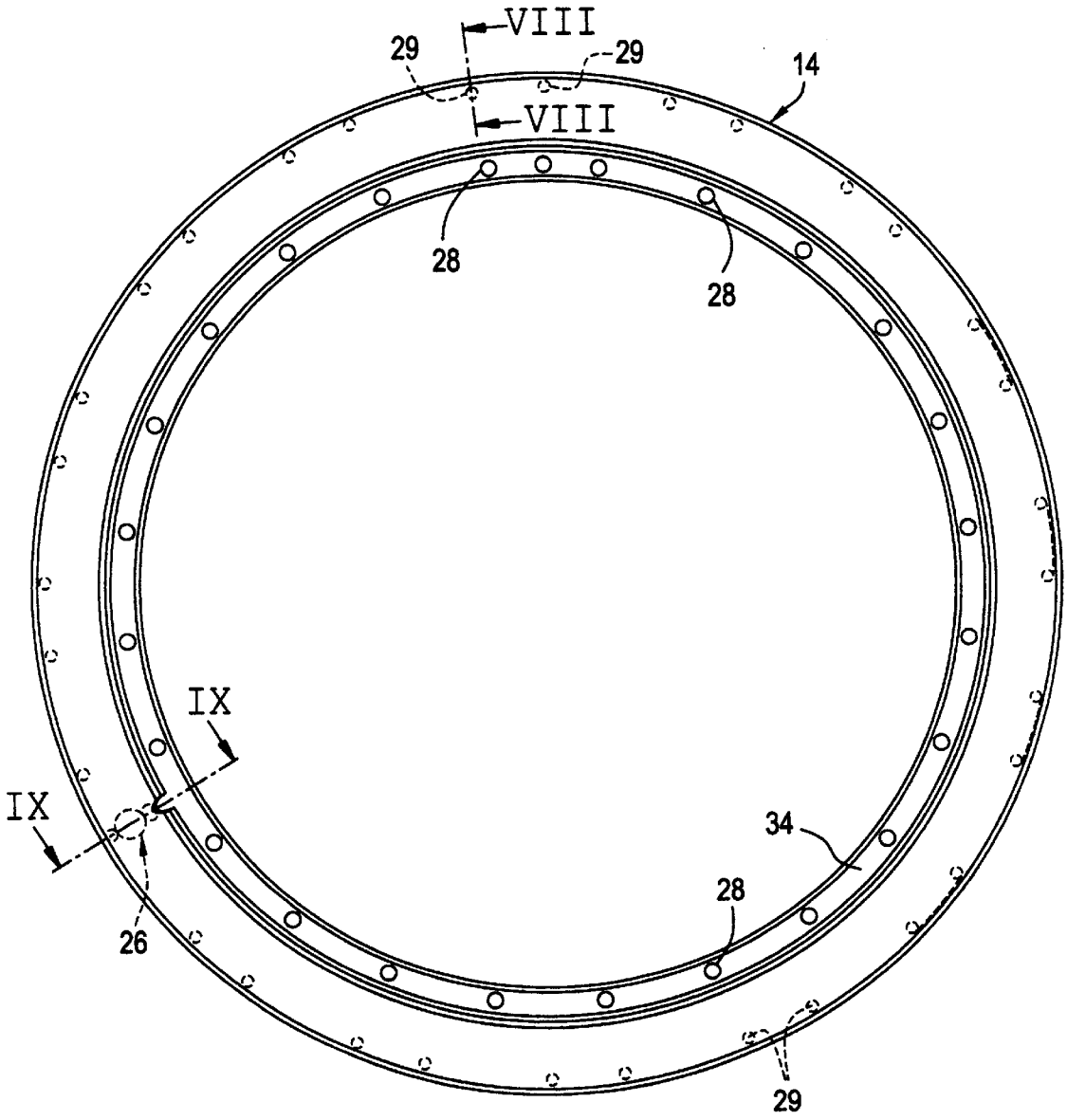
FIG. 7 shows a front view of a locking and support ring, in accordance with the device according to the present invention.
Figure 8:
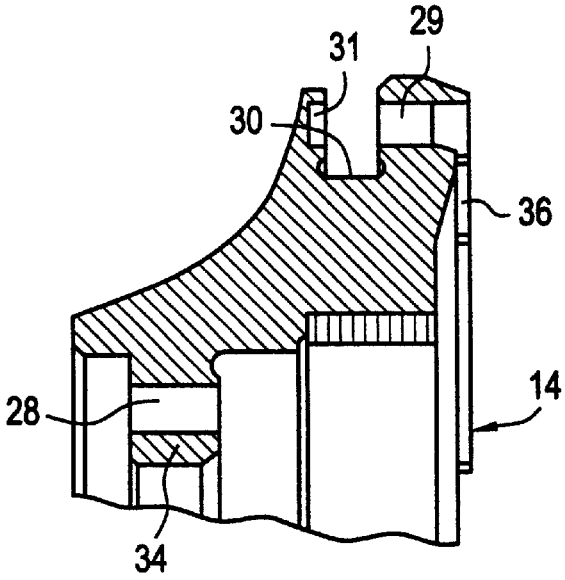
FIG. 8 shows a view according to the cross-section along the line VIII—VIII in FIG. 7.
Figure 9:
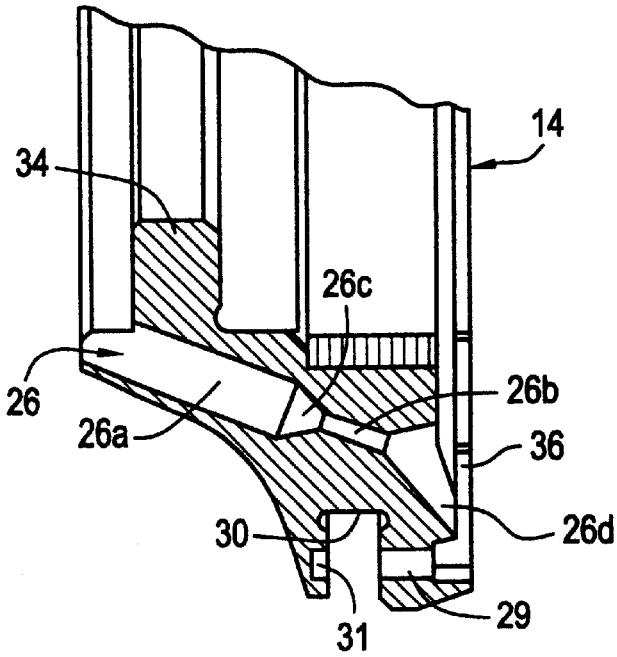
FIG. 9 shows a view according to the cross-section along the line IX—IX in FIG. 7.

The groups 12 of stator vanes 13 are locked on the interior by means of a ring 14, which can be seen in FIG. 7, and has a first, outer series of holes 29, and a second, inner series of holes 28.

The through hole 28, which is provided on an internal extension 34 of the ring 14, is used in order to secure the ring 14 itself to the structure of the gas turbine.

It can be seen that a peripheral portion of the ring 14 has a circumferential groove 30, which communicates with the through holes 29, which in turn are aligned with corresponding blind holes 31.

The groups 12 of stator vanes 13 have on their interior a series of plates 43, which in turn are provided with holes 33, and are inserted inside the circumferential groove 30, such that the holes 33 communicate with the through holes 29.

The groups 12 of stator vanes 13 are locked onto the ring 14 by means of pins 50 which pass through the holes 29 and the holes 33.

There is also provided a circumferential recess 36, associated with the lip of the ring 14, which communicates at its own ends with the pins 50 inserted in the various holes 33 and 29.

A further characteristic of the invention consists in the fact that each of the groups 12 of stator vanes 13 has projections 42, which abut the body of the gas turbine.

The ring 14 has a duct 26 for communication between the exterior of the combustion chamber and the portion downstream from the groups 12 of stator vanes 13, which opens onto a front portion of the ring 14, and has a first portion 26*a* and a second portion 26*b*, with a diameter smaller than the portion 26*a*, whereas the two portions 26*a* and 26*b* are connected to one another by a further, frusto-conical portion 26*c*.

In the rear portion of the ring 14, the duct 26 opens facing the plate-type element 36, with a final, frusto-conical portion 26*d*.

When the gas turbine is functioning, the flow of high-temperature gas tends to thrust the group 12 of stator vanes 13 in an axial direction towards the area of the rotor blades.

However, the locking system described, and in particular the projections 42, when they abut the body of the gas turbine, tend to hold the group 12 in position.

In addition, the flow of gas onto the stator vanes 13 tends to rotate the group 12, whereas the shape of the nozzles 15 conveys the flow of gas in a direction appropriate to make the rotor of the turbine function.

This tendency of the group 12 to rotate is counterbalanced by the connection of groups 12 to the ring 14, by means of the plates 43, which are inserted inside the circumferential groove 30.

The description provided makes apparent the characteristics and advantages of the support and locking device for nozzles of a high-pressure stage in gas turbines, which is the subject of the present invention.

It will be appreciated that many variants can be provided for the support and locking device for nozzles of a high-pressure stage in gas turbines, which is the subject of the present invention, without departing from the principles of novelty inherent in the inventive concept.

Finally, it will be appreciated that any materials, shapes and dimensions of the details illustrated can be used, as required, in the practical embodiment of the invention, and can be replaced by others which are technically equivalent.

What is claimed is:

1. A high-pressure stage for a gas turbine having combustion chambers including combustion liners, comprising:

a plurality of groups of stator vanes;

a plurality of outer sealing plates for sealing connection between said groups of stator vanes and outer portions of the liners of the combustion chambers;

a plurality of inner sealing plates for sealing between said groups of stator vanes and inner portions of the liners of the combustion chambers;

an inner ring for supporting and locking said groups of stator vanes to fixed structure of the gas turbine, said ring having a first series of outer holes for connection with the groups of stator vanes and a second series of inner holes along an inner extension of said ring for securing said ring to said gas turbine structure, said ring including a duct in communication on opposite sides thereof between an exterior of said combustion chamber and a turbine portion downstream from said groups of stator vanes, said duct opening through a front portion of said ring and having a first portion, and a second portion with a diameter smaller than said first portion, and a frustoconical portion connecting said first and second portions to one another.

2. A turbine stage according to claim 1 including a second frustoconical portion forming part of said duct and opening through a rear portion of said ring.

3. A turbine stage according to claim 1 wherein each of said groups of stator vanes is disposed between outer and inner arched profiles.

4. A turbine stage according to claim 1 wherein said groups of stator vanes have outer slots forming parts of the sealing connection between said groups of stator vanes and said outer sealing plates, and inner slots forming parts of the sealing connection between said groups of stator vanes and said inner sealing plates.

5. A turbine stage according to claim 4 including first pins extending through said outer slots and connecting each of said groups of said stator vanes and said outer sealing plates, and second pins extending through said inner slots and connecting said groups of stator vanes and said inner sealing plates.

6. A turbine stage according to claim 5 including springs about said pins for biasing said plates into engagement with said groups of stator vanes.

7. A turbine stage according to claim 1 wherein said ring has a circumferential groove about a peripheral portion thereof in communication with said outer holes and blind holes opening into said groove in alignment with said groove and said outer holes.

8. A turbine stage according to claim 7 wherein said groups of stator vanes have interior plates with holes, said plates being inserted into said circumferential groove such that said holes are aligned with said outer holes for receiving pins therein to reinforce the locking of said groups of said stator vanes to said ring.

9. A turbine stage according to claim 7 wherein said ring has a circumferential recess associated with a lip of said ring and opening into said holes for receiving said pins through said recess.

10. A turbine stage according to claim 7 wherein each of said groups of said stator vanes has projections for abutting the turbine structure.

11. A turbine stage according to claim 1 wherein each of said groups of stator vanes include a pair of stator vanes forming nozzles enabling a flow of gas therethrough, said stator vanes having a plurality of cooling holes opening through surfaces thereof.

* * * * *